US008665252B2

(12) United States Patent
Clatanoff

(10) Patent No.: US 8,665,252 B2
(45) **Date of Patent: *Mar. 4, 2014**

(54) DUTY CYCLE CALCULATION AND IMPLEMENTATION FOR SOLID STATE ILLUMINATORS

(75) Inventor: Todd A. Clatanoff, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/438,183

(22) Filed: Apr. 3, 2012

(65) Prior Publication Data

US 2013/0002728 A1 Jan. 3, 2013

Related U.S. Application Data

(63) Continuation of application No. 12/125,896, filed on May 22, 2008, now Pat. No. 8,149,252.

(51) Int. Cl.
*G09G 5/10* (2006.01)

(52) U.S. Cl.
USPC ..... 345/204; 345/690; 345/691; 345/692; 345/693; 345/214; 345/32; 345/108; 345/25; 345/26; 345/27; 345/28; 345/29; 345/30

(58) Field of Classification Search
USPC ..... 345/204, 690–93, 214, 32, 108; 349/25–30
See application file for complete search history.

(56) References Cited

U.S. PATENT DOCUMENTS 8,149,252 B2 * 4/2012 Clatanoff ..... 345/691

* cited by examiner

*Primary Examiner* — Alexander S Beck
*Assistant Examiner* — Jeffrey Steinberg
(74) *Attorney, Agent, or Firm* — Warren L. Franz; Wade J. Brady, III; Frederick J. Telecky, Jr.

(57) ABSTRACT

A display uses x illuminator systems to produce x primary colors and y overlap colors, which are combinations of primary colors, to illuminate a spatial light modulator in a display system. A first set of n duty cycles for the x primary colors over a frame is provided, wherein the display system can select any one of the duty cycles to produce a desired white point. A second set of n duty cycles of x+y colors over a frame corresponding to the first set of duty cycles is determined, where the second set of duty cycles are generated responsive to a specified desired allocation of the frame to the y overlap colors, such that each of the overlap colors can be displayed from a dark shade to a bright shade while maintaining a constant color point.

18 Claims, 5 Drawing Sheets

DUTY CYCLE CALCULATION AND IMPLEMENTATION FOR SOLID STATE ILLUMINATORS

This application is a continuation of application Ser. No. 12/125,896 filed Apr. 3, 2012 (now U.S. Pat. No. 8,149,252), the entirety of which is incorporated by reference herein.

BACKGROUND

This relates in general to electronic displays and, more particularly, to optimization of duty cycles for a display using solid state illumination.

Spatial light modulation (SLM) display systems are visual display systems that are used as an alternative to conventional cathode-ray tube (CRT) systems. SLM systems are used in a variety of applications such as televisions and video projectors. One type of SLM may be referred to as a projection display system. Due to their superior clarity and performance, they are often used in high-end applications such as high-definition television (HDTV).

One popular commercially available projection display system is the Texas Instruments DLP® system. The DLP® system utilizes a digital micromirror device (DMD), an array of thousands of tiny mirrors to properly reflect light from the light source to produce the image for display.

FIG. 1 illustrates a simplified configuration diagram illustrating selected components of an exemplary prior art display system 10. The display system 10 includes various components that define an optical path 5 between light source 11 and display screen 19. Light source 11 may be, for example, an ultra-high pressure (UHP) arc lamp. Display screen 19 may be separate from the display system 10 for a video projector or may be part of the display system 10 for a television. The display screen presents the visual image display intended to be seen by the viewer.

In operation, light emitted from the light source 11 is applied through a first condenser lens 12 and then through a rotating color wheel 13. Color wheel 13 will typically rotate at least once per frame (of the image to be displayed). The light passing through the color wheel 13 next passes through a second condenser lens 17 before illuminating DMD chip 15. It is chiefly the DMD chip 15 that modulates the light traveling through optical path 5 to produce a visual image.

To generate the images, the DMD chip 15 includes an array of tiny mirror elements, or micromirrors (typically on the order of one million of them). Each mirror element is separately controllable. For example, they may be mounted on a torsion hinge and support post above a memory cell of a CMOS static RAM as shown in FIG. 2. FIG. 2 shows a portion of a typical DMD chip 15 having mirror elements 21 suspended over a substrate 23. Electrostatic attraction between the mirror 21 and an address electrode 25 causes the mirror to twist or pivot, in either of two directions, about an axis formed by a pair of torsion beam hinges 27*a* and 27*b*. Typically, the mirror rotates about these hinges until the rotation is mechanically stopped. The movable micromirror tilts into the on or off states by electrostatic forces depending on the data written to the cell. The tilt of the mirror is on the order of plus 10 degrees (on) or minus 10 degrees (off) to modulate the light that is incident on the surface.

The DMD's are controlled by electronic circuitry (not shown) that has been fabricated on the silicon substrate 23 and is generally disposed under the DMD micromirror array. The circuitry includes an array of memory cells (also not shown), typically one memory cell for each DMD element, connected to the address electrodes 25. The output of a memory cell is connected to one of the two address electrodes and the inverted output of a memory cell is connected to the other address electrode.

The operation data is provided by a timing and control circuit 17 as determined from signal processing circuitry according to an image source 16 (as shown in FIG. 1). Once data is written to each memory cell in the array, a voltage is applied to the individual DMD mirrors 21 creating a large enough voltage differential between the mirrors 21 and the address electrodes 25 to cause the mirrors to rotate or tilt in the direction of the greatest voltage potential. Since the electrostatic attraction grows stronger as a mirror is rotated near an address electrode, the memory cell contents may be changed without altering the position of the mirrors once the mirrors are fully rotated. Thus, the memory cells may be loaded with new data while the array is displaying previous data.

As should be apparent, the rotation of the individual mirror elements 21 determines the amount and quality of light that will be directed at lens 18. The light reflected from any of the mirrors may pass through a projection lens 18 in order to create images on the screen 19. The intensity of each pixel displayed on the screen 19 is determined by the amount of time the mirror 21 corresponding to a particular pixel directs light toward screen 31. For example, each pixel may have 256 intensity levels for each color (e.g., red, green or blue). If the color level selected for a particular pixel at a particular time is 128, then the corresponding mirror would direct light toward that area of screen 31 for ½ (e.g., 128/256) of the frame time.

More recently, LEDs are used for the light source 11, rather than a lamp. LEDs provide significant advantages over white light lamps: (1) the LEDs have a longer expected life and (2) LEDs can have different associated colors, therefore red (R), blue (B) and green (G) LEDs can be used in order to eliminate the color wheel 13. By eliminating the color wheel, a moving part is eliminated, but, further, the control 17 does not need to account for changing colors sweeping across the mirrors as the segments of the color wheel rotate in front of the light.

FIG. 3 is a simplified configuration diagram illustrating selected components of an exemplary optical path 20 using LEDs. As with the example of FIG. 1, optical path 20 is part of a projection display system (although the projection lens and the display screen are not shown in FIG. 3). Exemplary optical path 20 of FIG. 3 is a "fixed array" system, having three stationary arrays; red array 28, green array 30, and blue array 32. No moving parts, such as color wheel 13 shown in FIG. 1, are needed. The light is applied sequentially by turning on and off each of the red, green, and blue arrays.

In operation, light from blue LED array 32 is transmitted via lens 33 through filter 34 and filter 35 to optical integrator 36. Likewise, light from green LED array 30 is passed through lens 31 and then is reflected from filter 34 but then transmitted through filter 35 to optical integrator 36. Light from red LED array 26 is reflected from filter 35 to optical integrator 36. Light from optical integrator 36 is transmitted to (and through) relay lenses 37 and 38, from where it is directed to DMD array 15. Light from DMD array 15 is then selectively directed to a projection lens (not shown) and on to a screen or other display medium (also not shown).

FIG. 4 illustrates a sequence of video frames 50, where each frame typically displays a multiple sub-frames 51 of red, green and blue sub-sequences 52. The primary color sub-sequences are not necessarily the same length; as shown, the green sub-sequence is longer than the red or blue sub-sequence. The allocation of a frame between different light colors is referred to herein as the duty cycle. In the illustrated embodiment, the fractional allocation of the frame is approximately 0.25 R, 0.5 G and 0.25 B. While each color is shown in FIG. 4 as being a single sub-sequence, one or more of the colors may be split into multiple sub-sequences; for example, for the illustrated allocation of colors, a sequence of primary color sub-sequences may be: R, G, B, G, where each of the four sub-sequences is approximately 0.25 of the whole.

Other details regarding the operation of a digital display system are provided in U.S. Pub. Nos. US2005/0146541 and US2005/0068464 (now U.S. Pat. Nos. 7,161,608 and 7,164,397), which are incorporated by reference herein.

Another advantage of LED technology is that the duty cycle for a frame may be varied for a number of reasons, whereas the duty cycle of colors produced by a color wheel is fixed. Display manufacturers desire multiple duty cycles in order to adjust the white point (which is monitored in real time) and to account for variations due to aging, temperature and so on.

LED technology, however, has lagged behind arc lamp technology in being able to achieve comparable screen lumens. In order to achieve greater brightness from the LEDs, some manufacturers use screens with higher gains; unfortunately, higher gain screens have a narrower viewing angle. A preferable alternative is to illuminate the DMD with multiple primary color LEDs simultaneously to produce overlap colors (referred to as "overlap" colors because they use simultaneously enabled multiple illuminators). For example, using red, green and blue LEDs, cyan (C) can be made from B+G, yellow (Y) can be made from R+G, magenta (M) can be made from B+R and white can be made from R+B+G. Using multiple illuminators simultaneously increases the amount of light reflected by the DMD, thus increasing the brightness of the picture.

While a RGBCMYW system is possible, it is also possible to use less than all of the overlap colors. For illustration purposes, it will be assumed herein that only the Y and C overlap colors are used.

The video data is typically received by control circuit 17 in an RGB format. The portion of the control circuit 17 that generates the overlap colors is shown in FIG. 5. There are two currently used methods for generating the primary and overlap pixel data from RGB data. These methods, Brilliant Color 1 (BC1) and Brilliant Color 2 (BC2), use multiple lookup tables (LUTs) which are accessed using the RGB data. BC1 differs from BC2 in that the overlap colors are treated as functions of R, G and B in BC1, while each color is treated independently in BC2. The information from the lookup tables is used to map data from RGB to RGBYC (or other combination of primary and overlap colors) pixel data by BC control circuitry 42. The mapping data in the LUTs is dependent upon the RGB duty cycle, which heretofore has been fixed.

As explained above, it is desirable to have multiple RGB duty cycles for maintaining a proper color balance during operation of the display and to adjust for the effects of aging. However, multiple duty cycles provide significant hurdles for generating overlap colors to increase brightness. Importantly, if the duty cycles can be switched in real time, the data in the LUTs 40 would need to be replaced for each switch of the RGB duty cycle changed in order to maintain consistent colors. Changing the data in the LUTs would take significant time relative to the operations of the controller 17, thus causing noticeable artifacts. Further, even if duty cycle switches are not made in real time, storage of mapping data for each possible duty cycle would require a significant amount of FLASH memory.

Therefore, a need has arisen for an efficient method and apparatus for maintaining color consistency over multiple RGB duty cycles.

SUMMARY

In the invention, x illuminator systems are controlled to produce x respective primary colors using a single illuminator system and y distinct overlap colors using two or more illuminator systems to illuminate a spatial light modulator in a display system. A first set of n duty cycles for the x primary colors over a frame is provided, wherein the display system can select any one of the duty cycles to produce a desired white point. A second set of n duty cycles of x+y colors over a frame corresponding to the first set of duty cycles is determined, wherein the second set duty cycles are generated responsive to a specified desired allocation of the frame to the y overlap colors, such that each of the overlap colors can be displayed from a dark shade to a bright shade while maintaining a constant color point.

The invention provides significant advantages over the prior art. First, the invention generates duty cycles that allow a single set of mapping tables to be used to map data from a first set of colors to a second set of colors including one or more selected overlap colors over multiple duty cycle sequences. Second, the duty cycles yield a constant color point across ramp of each overlap color to avoid variations in hue as the overlap colors are used within a frame. Third, the second set of duty cycles may be generated to have a constant ratio between each primary color and the same illuminator with an overlap color. Fourth, the data from the generated second set of duty cycles may be used to modulate the illuminators during overlap color sub-sequences either as a matter of time or current. Fifth, the second set of duty cycles can be calculated to account for non-ideal illumination sources.

BRIEF DESCRIPTION OF THE DRAWINGS

For a more complete understanding of the invention, and the advantages thereof, reference is made to the following description taken in conjunction with the accompanying drawings, in which.

DETAILED DESCRIPTION OF EXAMPLE EMBODIMENTS

The invention is best understood in relation to FIGS. 1-11 of the drawings, like numerals being used for like elements of the various drawings.

The invention determines an optimum set of duty cycles for a frame using both primary and overlap colors, based on a set of one or more predetermined duty cycles for primary colors only (in this case, assumed to be RGB duty cycles). This allows a display manufacturer to use multiple RGB duty cycles and still use one or more of the overlap colors (in this case, Y, C, M and W) to boost brightness.

For illustration purposes, a set of desired RGB duty cycles is shown in Table 1. In this example, there are twenty five unique duty cycles. A display may switch its duty cycle based on a number of factors, and switching between duty cycles may be performed in real time.

TABLE 1

Example of RGB Duty Cycle Set

| RGB Duty Cycle # | Rexp | Gexp | Bexp |
|---|---|---|---|
| 0 | 0.25393 | 0.49821 | 0.24786 |
| 1 | 0.26079 | 0.51081 | 0.22840 |
| 2 | 0.26667 | 0.52157 | 0.21176 |
| 3 | 0.26792 | 0.47110 | 0.26098 |
| 4 | 0.27172 | 0.48622 | 0.24205 |
| 5 | 0.28053 | 0.44672 | 0.27275 |
| 6 | 0.28215 | 0.49435 | 0.22349 |
| 7 | 0.28506 | 0.50838 | 0.20656 |
| 8 | 0.28636 | 0.45913 | 0.25451 |
| 9 | 0.28921 | 0.42099 | 0.28979 |
| 10 | 0.29039 | 0.51717 | 0.19243 |
| 11 | 0.29215 | 0.47247 | 0.23538 |
| 12 | 0.29952 | 0.43483 | 0.26565 |
| 13 | 0.30121 | 0.48112 | 0.21767 |
| 14 | 0.30717 | 0.48987 | 0.20296 |
| 15 | 0.30746 | 0.44544 | 0.24710 |
| 16 | 0.31044 | 0.40831 | 0.28124 |
| 17 | 0.31581 | 0.45655 | 0.22765 |
| 18 | 0.32149 | 0.41742 | 0.26108 |
| 19 | 0.32296 | 0.46602 | 0.21102 |
| 20 | 0.33044 | 0.47586 | 0.19370 |
| 21 | 0.33183 | 0.42964 | 0.23853 |
| 22 | 0.33492 | 0.39370 | 0.27138 |
| 23 | 0.33626 | 0.48349 | 0.18025 |
| 24 | 0.33813 | 0.44153 | 0.22034 |

Each duty cycle sequence includes the expected fractional portion of the frame utilized for each of the primary colors, where the sum of the expected portions equals "1" (i.e., Rexp+Gexp+Bexp=1).

Figure 6:
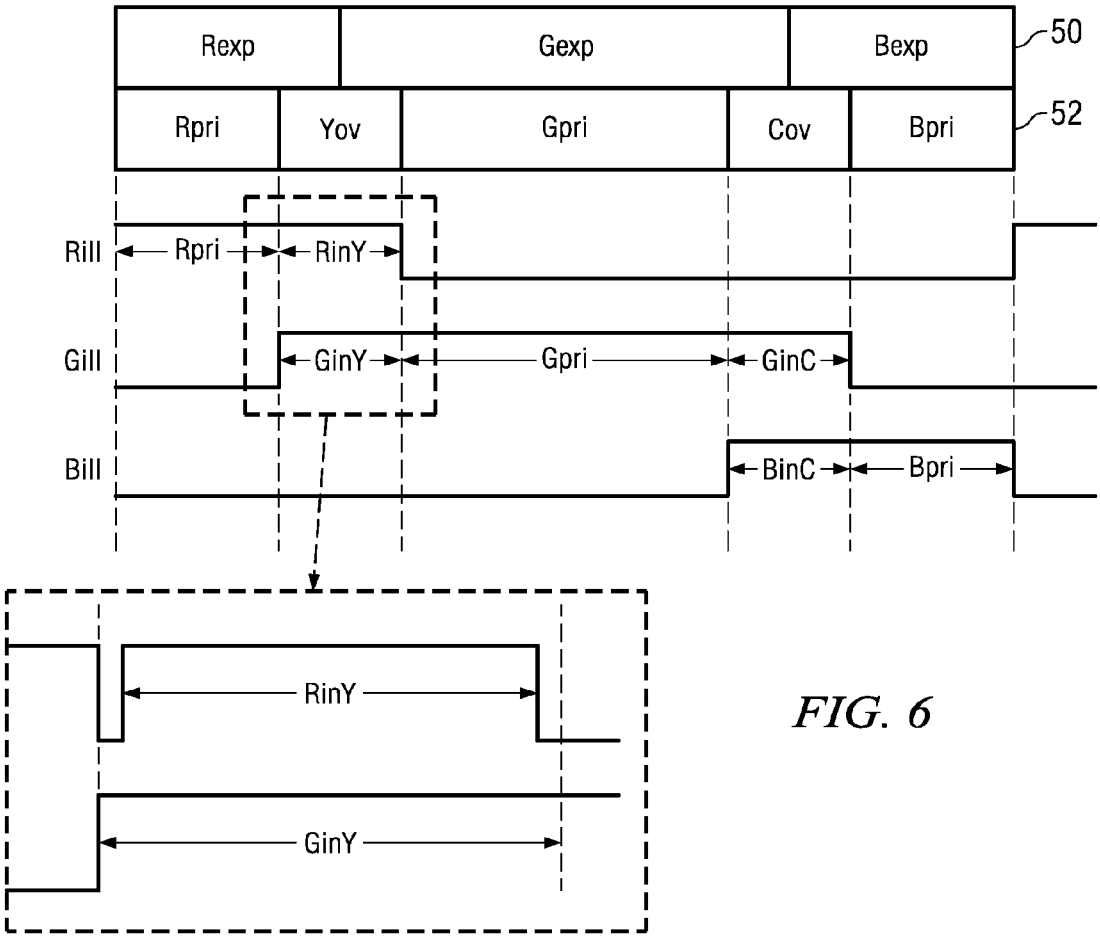
FIG. 6 illustrates an RGB duty cycle and corresponding RGBYC duty cycle.

FIG. 6 illustrates the different terms used herein. The expected duty cycle 50 shows the frame divided into the expected portions Rexp, Gexp and Bexp. In an actual embodiment, the colors could be in any order and one or more of the colors could be split into multiple sub-sequences. For each RGB duty cycle sequence in the set, the allocation between Rexp, Gexp and Bexp will be slightly different.

Below the expected duty cycle 50, is an RGBYC duty cycle 52 which is divided between the primary colors, Rpri, Gpri and Bpri (where only a single illuminator R, G, or B is enabled), and overlap colors, Yov and Cov. If more overlap colors were used, there would be sub-sequences for additional colors such as Mov and Wov. The total of the sub-sequences, TotDC, equals '1', i.e., Rpri+Gpri+Bpri+Yov+Gov=1. The primary and overlap colors could be arranged in any order.

Below the expected duty cycle is a timing diagram for the R, G and B illuminators, Rill, Gill and Bill. Rill is enabled for all of the Rpri sub-sequence and for at least a portion of the Yov sub-sequence (and the Mov and/or Wov sub-sequences, if used); Gill is enabled for all of the Gpri sub-sequence and for at least a portion of the Yov sub-sequence and Cov sub-sequence (and the Wov sub-sequence, if used); and Bill is enabled for all of the Bpri sub-sequence and for at least a portion of the Cov sub-sequence (and the Mov and/or Wov sub-sequences, if used). The portion of the R illuminator used in a Y sub-sequence is denoted as RinY, the portion of the G illuminator used in a Y sub-sequence is denoted as GinY, and so on. A close up of the timing diagram for the Yov sub-sequence shows that RinY is slightly less than the length of the Yov sub-sequence (the portion of the Yov sub-sequence in which the Rill illuminator is enabled is not necessarily centered in the Yov sub-sequence as shown, particularly if the Yov sub-sequence is preceded by the Rpri sub-sequence). At least one of the constituent primary illuminators in an overlap color sub-sequence should be enabled for the entire sub-sequence. The other illuminator (or illuminators) is preferably on as long as possible to provide maximum brightness. As will be shown below, however, it may be necessary to enable a primary color illuminator for less than the entire overlap color sub-sequence in order to obtain the correct proportion of colors over a frame.

The totals for each of the illuminator colors is shown below, with the M and W terms not used in the illustrated embodiment in parenthesis:

$$Rtot=Rpri+RinY+(RinM+RinW)$$

$$Gtot=Gpri+GinY+GinC+(GinW)$$

$$Btot=Bpri+BinC+(BinM+BinW)$$

$$RGBtot=Rtot+Gtot+Btot$$

If there are any overlap colors being used, RGBtot>1. Further, the total of the primary colors (not including the overlap colors), RGBpri=Rpri+Gpri+Bpri, will be less than '1'.

Figure 7:
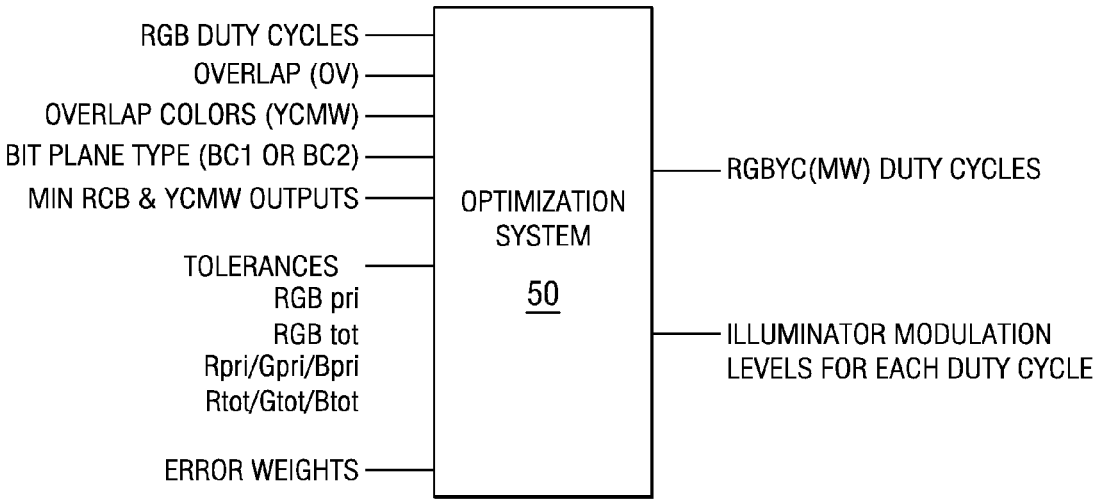
FIG. 7 illustrates an optimization system for generating a set of output duty cycles using overlap colors from a set of RGB duty cycles.

FIG. 7 illustrates a block diagram of an optimization system 50 for generating expanded-color duty cycles based on a set of RGB (or other primary color set) input duty cycles. For illustration, it will be assumed that the expanded overlap colors are Y and C, although M and W could be produced from an RGB primary color set as well.

The optimization system generates the expanded color duty cycles apart from the display circuitry; this information is used to prepare a look-up table for use in the controller, where the lookup table associates each expanded color duty cycle with a chosen index for the corresponding RGB duty cycle. When the display requests a new RGB duty cycle, the index is used to look up the expanded duty cycle from the look-up table. Further details are provided in connection with FIG. 8.

In FIG. 7, the optimization system receives the RGB duty cycle information, such as shown in Table 1. An overlap percentage (OV) is provided for the portion of the frame which will be illuminated by one or more overlap colors. In the illustrated embodiment, this is set to 0.15 (15%). Thus, Yov+Cov should be approximately 0.15 in the resulting output duty cycles. The overlap percentage is a soft constraint which may vary somewhat from the selected OV. The user also specifies which overlap colors will be used in the output duty cycle (any combination of Y, C, M, and/or W can be used in the illustrated embodiment). BC1 or BC2 is also entered—if BC1 is selected, a hard constraint of constant ratios between each primary color and the same illuminator in each overlap color, discussed below in connection with Table 5, will be enforced. The user inputs the minimum RCB and YCMW outputs. For example, the minimum duty cycle for a R, G or B sub-sequence might be 0.15, while the minimum duty cycle for a Y, C, M or W sub-sequence might be 0.06.

Tolerances and error weights are also input. In the preferred embodiment, tolerances are provided for various calculations. For example, for an allocation of 0.15 to the overlap colors, RGBpri could have an associated tolerance of +/−0.03; in this case, RGBpri for a given duty cycle could be in the range of 0.82 to 0.88. RGBtot for a possible duty cycle could be in the range of 1.12 to 1.18. Individually, tolerances can be provided to the individual Rpri, Gpri and Bpri sub-sequences. For example, as discussed above in connection with a desired RGB duty cycle of 0.25/0.5/0.25 with 15% of the frame allocated to the overlap colors, Rpri should equal 0.25*(1−0.15)=0.2125. With a tolerance of +/−0.05 for the RGB individual primaries, Rpri could vary between 0.1625 and 0.2625 in the scenarios evaluated by the optimization system 50. Similarly, tolerances can be provided for Rtot, Gtot and Btot individually. For the RGB duty cycle of 0.25/0.5/0.25 with 15% of the frame allocated to the overlap colors, Rtot should be equal to 0.25*1.15=0.2875. A tolerance of +/−0.05 would allow it to vary between 0.2375 and 0.3375 in the scenarios evaluated by the optimization system 50. Error weights are assigned to each error function calculated by the optimization system 50; this allows some errors to have a greater effect on the selected output duty cycle sequences than other errors. The error functions, in general, calculate factors that will affect both brightness and color conformity. Assigning higher weights to brightness may result in a brighter display, albeit with slight color variations from the desired RGB proportions, while higher weights to the color conformity functions will result in better conformity with somewhat less brightness.

The optimization system 50 includes processing hardware executing optimization software which evaluates multiple scenarios to determine an optimum solution given one or more constraints and variables. An example of such a system is the LINDO API by Lindo Systems Inc. of Chicago, Ill. In the illustrated embodiment the variables are the length of each color sub-sequence (RGBYCMW) and the modulation levels for each primary color within an overlap color sub-sequence (i.e., the portion of the overlap color sub-sequence during which each constituent primary color is enabled or, alternatively, the degree to which an illuminator is driven). The constraints include the minimum RGB and YCMW sub-sequences and the tolerances. For a BC1 optimization, there is a further constraint that the ratios of primary colors to the same illuminator in an overlap color must be identical for each output duty cycle (see Table 5).

The optimizer evaluates each scenario and determines the optimum scenario based on a total weighted error.

The following tables and text describe the calculations from which an optimum solution is determined for the case of a BC1 bit plane. To show the calculations, the optimized result is shown for the RGB duty cycles of Table 1, using a 15% OV, with Y and C overlap colors. Table 2 shows the optimized duty cycle, Tables 3 and 4 show the modulation levels for Y and C.

TABLE 2

Optimized Output Duty Cycles, Seq Color Perspective

| # | TotDC | RGBpri | Rpri | Gpri | Bpri | Yov | Cov | Mov | Wov |
|---|---|---|---|---|---|---|---|---|---|
| 0 | 1.000 | 0.8447 | 0.24373 | 0.39546 | 0.20554 | 0.08568 | 0.06960 | 0.00000 | 0.00000 |
| 1 | 1.000 | 0.8428 | 0.23412 | 0.40049 | 0.20815 | 0.08677 | 0.07048 | 0.00000 | 0.00000 |
| 2 | 1.000 | 0.8398 | 0.23091 | 0.40801 | 0.20087 | 0.08840 | 0.07181 | 0.00000 | 0.00000 |
| 3 | 1.000 | 0.8473 | 0.25621 | 0.38893 | 0.20214 | 0.08426 | 0.06845 | 0.00000 | 0.00000 |
| 4 | 1.000 | 0.8473 | 0.25621 | 0.38893 | 0.20214 | 0.08426 | 0.06845 | 0.00000 | 0.00000 |
| 5 | 1.000 | 0.8465 | 0.25715 | 0.37779 | 0.21157 | 0.08185 | 0.07164 | 0.00000 | 0.00000 |
| 6 | 1.000 | 0.8473 | 0.25633 | 0.38887 | 0.20211 | 0.08425 | 0.06844 | 0.00000 | 0.00000 |
| 7 | 1.000 | 0.8434 | 0.24770 | 0.39878 | 0.19694 | 0.08640 | 0.07018 | 0.00000 | 0.00000 |
| 8 | 1.000 | 0.8486 | 0.26250 | 0.38565 | 0.20044 | 0.08355 | 0.06787 | 0.00000 | 0.00000 |
| 9 | 1.000 | 0.8438 | 0.25012 | 0.36746 | 0.22622 | 0.07961 | 0.07660 | 0.00000 | 0.00000 |
| 10 | 1.000 | 0.8410 | 0.25168 | 0.40494 | 0.18438 | 0.08773 | 0.07127 | 0.00000 | 0.00000 |
| 11 | 1.000 | 0.8486 | 0.26250 | 0.38565 | 0.20044 | 0.08355 | 0.06787 | 0.00000 | 0.00000 |
| 12 | 1.000 | 0.8472 | 0.25893 | 0.38041 | 0.20785 | 0.08242 | 0.07038 | 0.00000 | 0.00000 |
| 13 | 1.000 | 0.8486 | 0.26250 | 0.38565 | 0.20044 | 0.08355 | 0.06787 | 0.00000 | 0.00000 |
| 14 | 1.000 | 0.8479 | 0.26367 | 0.38737 | 0.19686 | 0.08392 | 0.06817 | 0.00000 | 0.00000 |
| 15 | 1.000 | 0.8486 | 0.26250 | 0.38565 | 0.20044 | 0.08355 | 0.06787 | 0.00000 | 0.00000 |
| 16 | 1.000 | 0.8410 | 0.26108 | 0.35568 | 0.22422 | 0.08310 | 0.07592 | 0.00000 | 0.00000 |
| 17 | 1.000 | 0.8486 | 0.26250 | 0.38565 | 0.20044 | 0.08355 | 0.06787 | 0.00000 | 0.00000 |
| 18 | 1.000 | 0.8433 | 0.27110 | 0.36413 | 0.20803 | 0.08629 | 0.07044 | 0.00000 | 0.00000 |
| 19 | 1.000 | 0.8486 | 0.26250 | 0.38565 | 0.20044 | 0.08355 | 0.06787 | 0.00000 | 0.00000 |
| 20 | 1.000 | 0.8463 | 0.26637 | 0.39134 | 0.18862 | 0.08478 | 0.06887 | 0.00000 | 0.00000 |
| 21 | 1.000 | 0.8462 | 0.27550 | 0.37554 | 0.19518 | 0.08769 | 0.06609 | 0.00000 | 0.00000 |
| 22 | 1.000 | 0.8379 | 0.28062 | 0.34223 | 0.21502 | 0.08932 | 0.07281 | 0.00000 | 0.00000 |
| 23 | 1.000 | 0.8441 | 0.27029 | 0.39709 | 0.17671 | 0.08603 | 0.06989 | 0.00000 | 0.00000 |
| 24 | 1.000 | 0.8469 | 0.27184 | 0.37838 | 0.19666 | 0.08652 | 0.06659 | 0.00000 | 0.00000 |

In this table, TotDC is the sum of all primary and overlap colors; i.e., TotDC=Rpri+Gpri+Bpri+Yov+Cov=1. The sum of the primary colors alone, RGBpri=Rpri+Gpri+Bpri should be around TotDC-OV, about 0.85. RGBpri varies from TotDC-OV because the sum or the overlap colors, Yov+Cov, is allowed to vary slightly from OV.

TABLE 3

| Output Duty Cycles, Illuminator Perspective | | | | | | | | |
|---|---|---|---|---|---|---|---|---|
| # | RGBtot | Rpri | Gpri | Bpri | RinY | GinY | GinC | BinC |
| 0 | 1.147 | 0.2437 | 0.3955 | 0.2055 | 0.0776 | 0.0857 | 0.0696 | 0.0696 |
| 1 | 1.145 | 0.2341 | 0.4005 | 0.2081 | 0.0745 | 0.0868 | 0.0705 | 0.0705 |
| 2 | 1.142 | 0.2309 | 0.4080 | 0.2009 | 0.0735 | 0.0884 | 0.0718 | 0.0680 |
| 3 | 1.150 | 0.2562 | 0.3889 | 0.2021 | 0.0816 | 0.0843 | 0.0684 | 0.0684 |
| 4 | 1.150 | 0.2562 | 0.3889 | 0.2021 | 0.0816 | 0.0843 | 0.0684 | 0.0684 |
| 5 | 1.148 | 0.2572 | 0.3778 | 0.2116 | 0.0818 | 0.0818 | 0.0665 | 0.0716 |
| 6 | 1.150 | 0.2563 | 0.3889 | 0.2021 | 0.0816 | 0.0842 | 0.0684 | 0.0684 |
| 7 | 1.146 | 0.2477 | 0.3988 | 0.1969 | 0.0788 | 0.0864 | 0.0702 | 0.0667 |
| 8 | 1.151 | 0.2625 | 0.3856 | 0.2004 | 0.0836 | 0.0836 | 0.0679 | 0.0679 |
| 9 | 1.144 | 0.2501 | 0.3675 | 0.2262 | 0.0796 | 0.0796 | 0.0647 | 0.0766 |
| 10 | 1.143 | 0.2517 | 0.4049 | 0.1844 | 0.0801 | 0.0877 | 0.0713 | 0.0624 |
| 11 | 1.151 | 0.2625 | 0.3856 | 0.2004 | 0.0836 | 0.0836 | 0.0679 | 0.0679 |
| 12 | 1.149 | 0.2589 | 0.3804 | 0.2079 | 0.0824 | 0.0824 | 0.0670 | 0.0704 |
| 13 | 1.151 | 0.2625 | 0.3856 | 0.2004 | 0.0836 | 0.0836 | 0.0679 | 0.0679 |
| 14 | 1.151 | 0.2637 | 0.3874 | 0.1969 | 0.0839 | 0.0839 | 0.0682 | 0.0667 |
| 15 | 1.151 | 0.2625 | 0.3856 | 0.2004 | 0.0836 | 0.0836 | 0.0679 | 0.0679 |
| 16 | 1.140 | 0.2611 | 0.3557 | 0.2242 | 0.0831 | 0.0771 | 0.0626 | 0.0759 |
| 17 | 1.151 | 0.2625 | 0.3856 | 0.2004 | 0.0836 | 0.0836 | 0.0679 | 0.0679 |
| 18 | 1.143 | 0.2711 | 0.3641 | 0.2080 | 0.0863 | 0.0789 | 0.0641 | 0.0704 |
| 19 | 1.151 | 0.2625 | 0.3856 | 0.2004 | 0.0836 | 0.0836 | 0.0679 | 0.0679 |
| 20 | 1.149 | 0.2664 | 0.3913 | 0.1886 | 0.0848 | 0.0848 | 0.0689 | 0.0639 |
| 21 | 1.147 | 0.2755 | 0.3755 | 0.1952 | 0.0877 | 0.0814 | 0.0661 | 0.0661 |
| 22 | 1.134 | 0.2806 | 0.3422 | 0.2150 | 0.0893 | 0.0741 | 0.0602 | 0.0728 |
| 23 | 1.146 | 0.2703 | 0.3971 | 0.1767 | 0.0860 | 0.0860 | 0.0699 | 0.0598 |
| 24 | 1.149 | 0.2718 | 0.3784 | 0.1967 | 0.0865 | 0.0820 | 0.0666 | 0.0666 |

Table 3 illustrates calculation of the RGBtot for each duty cycle. Because more than one illuminator is enabled for each of the overlap colors, RGBtot>1. From Table 3, it can also be seen that for a given overlap color, both constituent colors are not necessarily enabled for the full sub-sequence. For example for index 0, RinY=0.0776 while GinY=0.0857. G is therefore on for the full Y sub-sequence, while R is on for somewhat less than the full sub-sequence. On the other hand, for index 18, RinY=0.0863 while GinY=0.0789. Table 4 illustrates the percentage of an overlap sub-sequence used by the constituent colors. As can be seen, for each overlap color, at least one constituent color uses the entire sub-sequence, while the other color generally uses a high percentage of the sub-sequence.

TABLE 4

| Overlap Color Ratios | | | | |
|---|---|---|---|---|
| # | RinY | GinY | GinC | BinC |
| 0 | 0.9054 | 1.0000 | 1.0000 | 1.0000 |
| 1 | 0.8588 | 1.0000 | 1.0000 | 1.0000 |
| 2 | 0.8314 | 1.0000 | 1.0000 | 0.9472 |
| 3 | 0.9678 | 1.0000 | 1.0000 | 1.0000 |
| 4 | 0.9678 | 1.0000 | 1.0000 | 1.0000 |
| 5 | 1.0000 | 1.0000 | 0.9281 | 1.0000 |
| 6 | 0.9684 | 1.0000 | 1.0000 | 1.0000 |
| 7 | 0.9126 | 1.0000 | 1.0000 | 0.9502 |
| 8 | 1.0000 | 1.0000 | 1.0000 | 1.0000 |
| 9 | 1.0000 | 1.0000 | 0.8442 | 1.0000 |
| 10 | 0.9131 | 1.0000 | 1.0000 | 0.8760 |
| 11 | 1.0000 | 1.0000 | 1.0000 | 1.0000 |
| 12 | 1.0000 | 1.0000 | 0.9512 | 1.0000 |
| 13 | 1.0000 | 1.0000 | 1.0000 | 1.0000 |
| 14 | 1.0000 | 1.0000 | 1.0000 | 0.9778 |
| 15 | 1.0000 | 1.0000 | 1.0000 | 1.0000 |
| 16 | 1.0000 | 0.9273 | 0.8245 | 1.0000 |
| 17 | 1.0000 | 1.0000 | 1.0000 | 1.0000 |
| 18 | 1.0000 | 0.9142 | 0.9097 | 1.0000 |
| 19 | 1.0000 | 1.0000 | 1.0000 | 1.0000 |
| 20 | 1.0000 | 1.0000 | 1.0000 | 0.9274 |
| 21 | 1.0000 | 0.9278 | 1.0000 | 1.0000 |
| 22 | 1.0000 | 0.8301 | 0.8272 | 1.0000 |

TABLE 4-continued

| Overlap Color Ratios | | | | |
|---|---|---|---|---|
| # | RinY | GinY | GinC | BinC |
| 23 | 1.0000 | 1.0000 | 1.0000 | 0.8562 |
| 24 | 1.0000 | 0.9474 | 1.0000 | 1.0000 |

While FIG. 6 shows the independent control of the illuminators within an overlap color using time based modulation, i.e., enabling one of the illuminators for less than the entire sub-sequence, the numbers shown in Table 4 could be used to control the current driving one of the illuminators, rather than the time that the illuminator is enabled. Thus, the illuminator could be enabled for the entire sub-sequence associated with the overlap color, albeit at a lower driving current. Thus, for example, for Y in the first duty cycle, the G illuminator could be driven at full current while the R illuminator was driven at about 90%.

The optimization system 50 calculates four error functions related to the overlap color ratios: Ydark, Cdark, Mdark and Wdark (to the extent applicable). Ydark=|1−RinY|+|1−GinY|, Cdark=|1−GinC|+|1−BinC|, Mdark=|1−RinM|+|1−BinM| and Wdark=|1−RinW|+|1−GinW|+|1−BinW|. The error functions are calculated for each duty cycle sequence being evaluated by the optimization system 50. For this example, the error functions have a weighting of 10. The purpose behind weighting these error functions highly (relative to other functions) is to produce a brighter picture.

The optimization system 50 also computes four error functions related to illumination relative to values based on the input values. The first error function computes the sum the overlap deviation from the specified value over all of the duty cycles. The overlap error function can be written as $$OVerr = \sum_{i=0}^{n-1} |1 + OV - RGBtot(i)|,$$

where n is the number of duty cycles in the set. In the example provided herein, 1+OV would equal 1.15. If W is used as one of the overlap colors, the equation needs to be changed slightly, since the W overlap color will use three primary colors simultaneously for a portion of the period used for overlap colors. If W is the only overlap color, the equation can be changed to $$OVerr = \sum_{i=0}^{n-1} |1 + 2OV - RGBtot(i)|.$$

If W is one of two or more overlap colors, then the best practice is to estimate the length of the W period for each duty cycle and add that length to 1+OV. RGB duty cycles with relatively equal R, G and B portions are likely to have a large W sub-sequence relative to RGB duty cycles with one of the primary colors having a sub-sequence larger than the others.

A second error function measures the difference between the sum of the RGB primaries (Rpri+Gpri+Bpri) and the expected portion of the frame for the primary colors (1−OV). Hence, the equation for this error over the set of duty cycles is:

$$\text{RGBsum_err} = \sum_{i=0}^{n-1} |1 - OV - RGBpri(i)|$$

A third error function measures a cumulative error between an expected amount of illumination (and the allocated amount of illumination) for each color in each of the duty cycles, if the total illumination was apportioned in the same percentage as the associated RGB duty cycle. This can be expressed as $$\text{RGBcum_err} = \sum_{i=0}^{n-1} |Rexp(i) * RGBtot(i) - Rtot(i)| + |Gexp(i) * RGBtot(i) - Gtot(i)| + |Bexp(i) * RGBtot(i) - Btot(i)|.$$

A fourth error function measures a cumulative error between the expected amount and the actual amount of primary illumination for each primary color in each duty cycle, if the primary illumination was apportioned in the same percentage as the associated RGB duty cycle. This error can be represented as RGBpri_err=|Rexp(i)*RGBpri(i)−Rpri(i)|+|Gexp(i)*RGBpri(i)−Gpri(i)|+|Bexp(i)*RGBpri(i)−Bpri(i)|.

For BC1 bit-planes, every output duty cycle has a constant ratio between the each primary color and the same illuminator within an overlap color, as shown in Table 5:

TABLE 5

| Ratios for Overlap colors | | | | |
|---|---|---|---|---|
| # | RinY/Rpri | GinY/Gpri | GinC/Gpri | BinC/Bpri |
| 0 | 0.3183 | 0.2166 | 0.1760 | 0.3386 |
| 1 | 0.3183 | 0.2166 | 0.1760 | 0.3386 |
| 2 | 0.3183 | 0.2166 | 0.1760 | 0.3386 |
| 3 | 0.3183 | 0.2166 | 0.1760 | 0.3386 |
| 4 | 0.3183 | 0.2166 | 0.1760 | 0.3386 |
| 5 | 0.3183 | 0.2166 | 0.1760 | 0.3386 |
| 6 | 0.3183 | 0.2166 | 0.1760 | 0.3386 |
| 7 | 0.3183 | 0.2166 | 0.1760 | 0.3386 |
| 8 | 0.3183 | 0.2166 | 0.1760 | 0.3386 |
| 9 | 0.3183 | 0.2166 | 0.1760 | 0.3386 |
| 10 | 0.3183 | 0.2166 | 0.1760 | 0.3386 |
| 11 | 0.3183 | 0.2166 | 0.1760 | 0.3386 |
| 12 | 0.3183 | 0.2166 | 0.1760 | 0.3386 |

TABLE 5-continued

| Ratios for Overlap colors | | | | |
|---|---|---|---|---|
| # | RinY/Rpri | GinY/Gpri | GinC/Gpri | BinC/Bpri |
| 13 | 0.3183 | 0.2166 | 0.1760 | 0.3386 |
| 14 | 0.3183 | 0.2166 | 0.1760 | 0.3386 |
| 15 | 0.3183 | 0.2166 | 0.1760 | 0.3386 |
| 16 | 0.3183 | 0.2166 | 0.1760 | 0.3386 |
| 17 | 0.3183 | 0.2166 | 0.1760 | 0.3386 |
| 18 | 0.3183 | 0.2166 | 0.1760 | 0.3386 |
| 19 | 0.3183 | 0.2166 | 0.1760 | 0.3386 |
| 20 | 0.3183 | 0.2166 | 0.1760 | 0.3386 |
| 21 | 0.3183 | 0.2166 | 0.1760 | 0.3386 |
| 22 | 0.3183 | 0.2166 | 0.1760 | 0.3386 |
| 23 | 0.3183 | 0.2166 | 0.1760 | 0.3386 |
| 24 | 0.3183 | 0.2166 | 0.1760 | 0.3386 |

Figure 5:
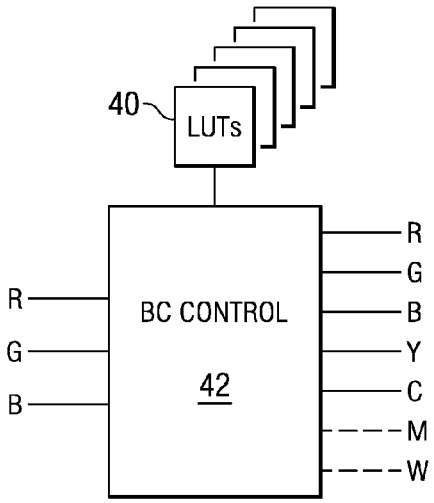
FIG. 5 (PRIOR ART)
FIG. 5 illustrates a prior art controller for mapping RGB data to RGBYCMW data.

For example, the ratio or RinY/Rpri is the same for all duty cycles. By maintaining a constant ratio across the duty cycles, the overlap colors maintain a consistent brightness as duty cycles are switched. Maintaining a consistent brightness for the overlap cycles can provide the benefit that a single LUT set 40, as shown in FIG. 5, can be shared across a set of RGB sequences that are switched in real time. Avoiding reloading of the LUT set 40 is critical for real time switching to avoid artifacts that would occur during the reload, specifically, the freezing of the picture during reload.

Table 6 illustrates the weighted error function for the example given above. This table shows the calculation for the optimum RGBYC duty cycles.

TABLE 6

| Weighted Errors | | | |
|---|---|---|---|
| Obj Function Error Components | Error | Weight | Weighted Error |
| Overlap Sum | 0.087848 | 1.000000 | 0.087848 |
| Sum of RGB Primaries | 0.113898 | 1.000000 | 0.113898 |
| R primary, G primary, B primary | 1.050806 | 1.000000 | 1.050806 |
| Cumul R, Cumul G, Cumul B | 1.339632 | 1.000000 | 1.339632 |
| Y Dark Time | 0.0980035 | 10.000000 | 0.980035 |
| C Dark Time | 0.0854661 | 10.000000 | 0.854661 |
| M Dark Time | 0.000000 | 10.000000 | 0.000000 |
| W Dark Time | 0.000000 | 10.000000 | 0.000000 |
| Total Obj Function Error | | | 4.426879 |

Figure 1:
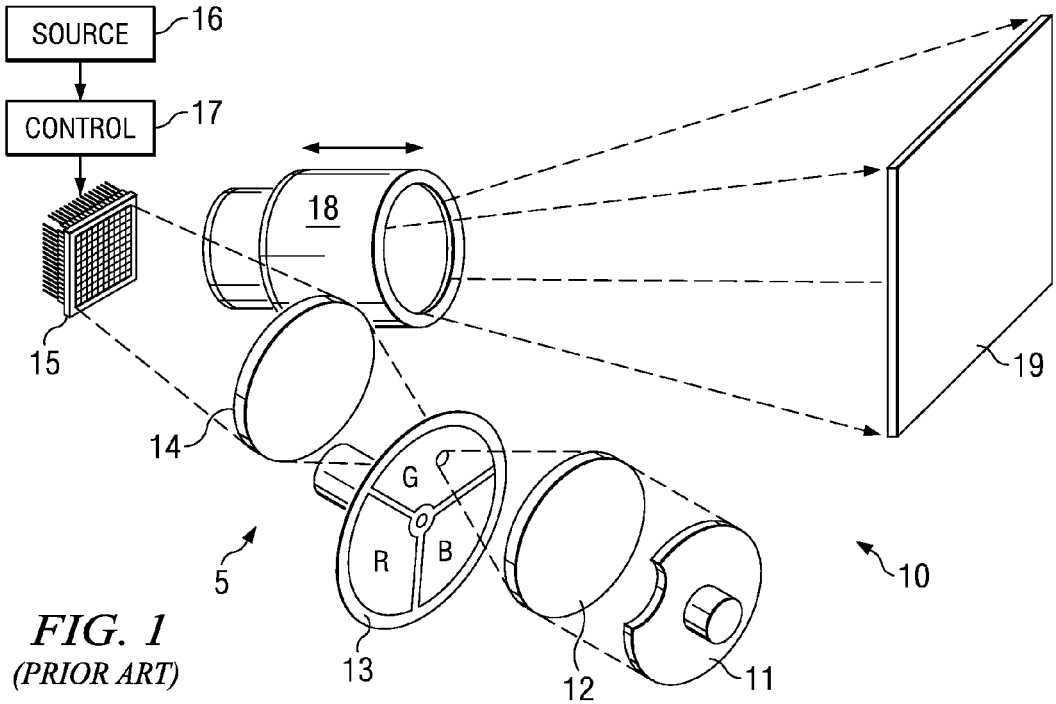
FIG. 1 (PRIOR ART)
FIG. 1 illustrates a block diagram of a prior art digital display system using a color wheel.
Figure 2:
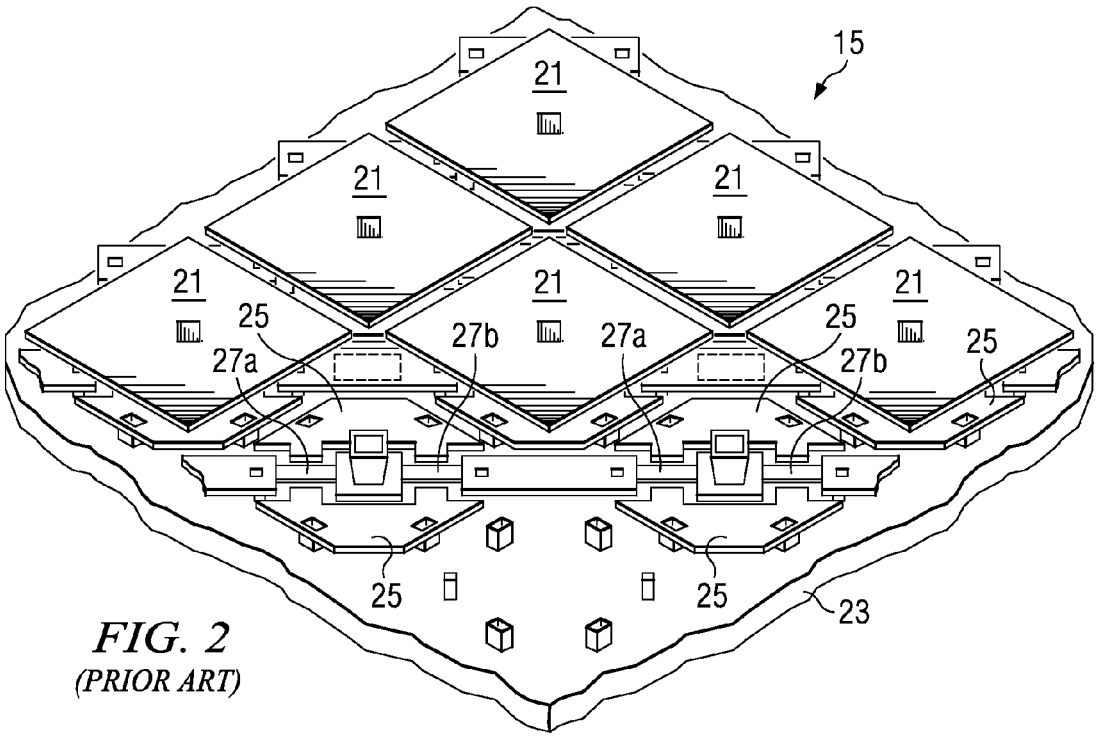
FIG. 2 (PRIOR ART)
FIG. 2 illustrates a prior art digital micro-mirror device (DMD)
Figure 3:
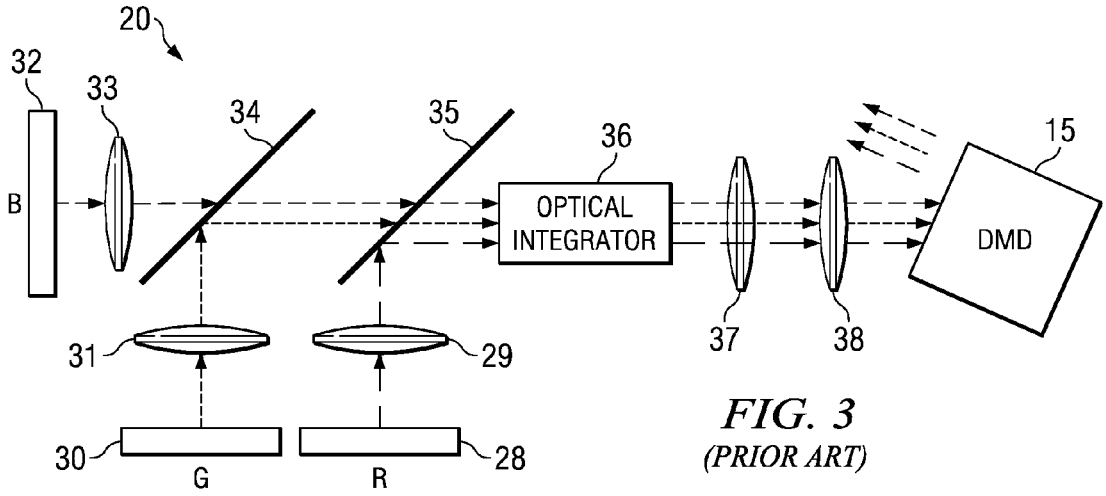
FIG. 3 (PRIOR ART)
FIG. 3 illustrates a prior art digital display system using solid state illuminators, such as light emitting diodes (LEDs)
Figure 4:
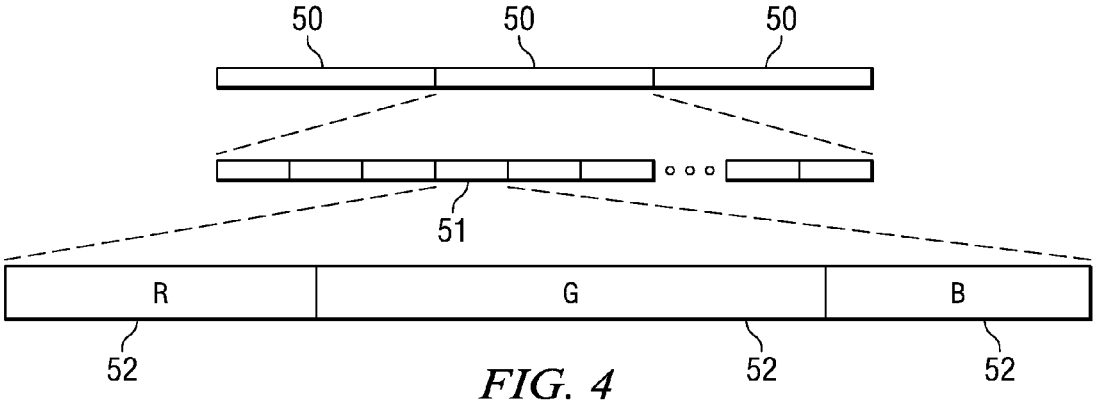
FIG. 4 illustrates a video stream of image frames as used in the prior art.
Figure 8:
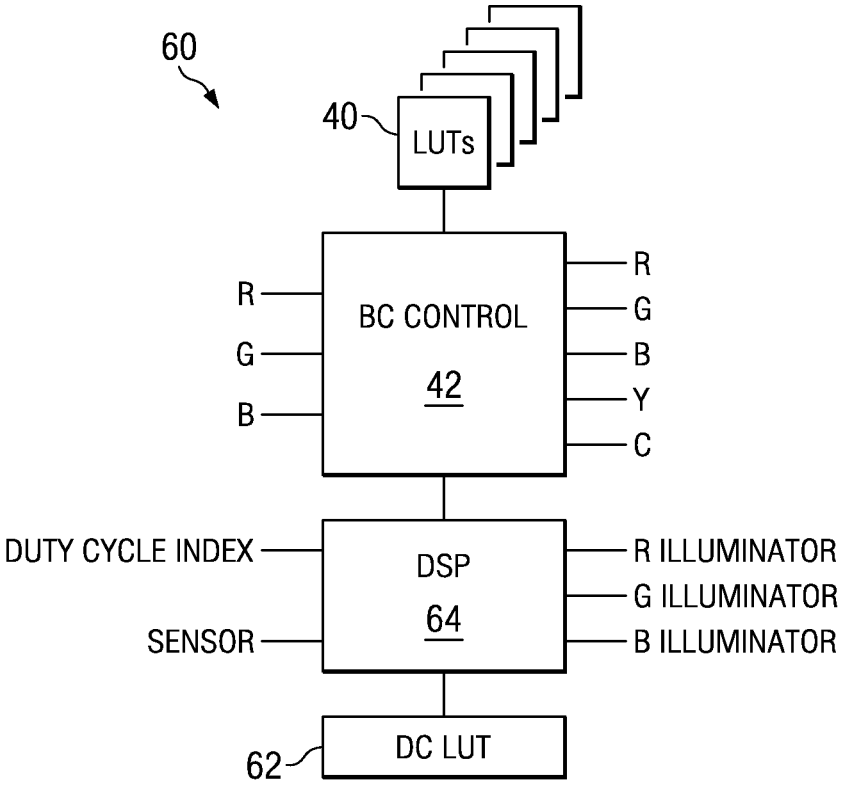
FIG. 8 illustrates a controller for a digital display using a lookup table to provide a duty cycle using overlap colors responsive to a reference to an RGB duty cycle.

FIG. 8 illustrates the control circuitry 60 for a display using the invention. The BC control 42, including a single set of LUTs, maps the RGB data to RGB (YCMW) data and shares the same mapping data between all duty cycle sequences. An additional LUT (DC LUT) 62 contains information on the output duty cycles, as shown in FIG. 2, along with the information for controlling the illuminators (either by time or current) during overlap color sub-sequences.

In operation, the duty cycle necessary to maintain the white point is calculated by the DSP using information from sensors associated with the illuminators, and the closest match is chosen from the DC LUT 62. This may occur periodically, each frame, or at selected times (such as startup). In some embodiments, the DSP may tweak the output of the illuminators by adjusting the current depending upon the selected duty cycle and the calculated duty cycle.

Importantly, the information in the LUTs remains constant as the duty cycle sequences are switched.

Figure 9:
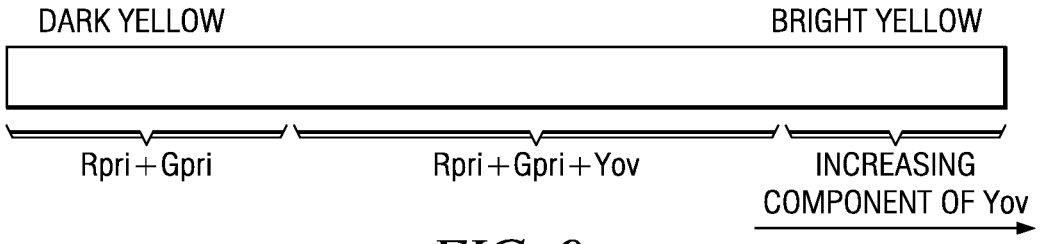
FIG. 9 illustrates a color ramp using primary colors and overlap colors.

Further, as shown in FIG. 9, the invention can provide overlap colors with the same color point as combined primaries. FIG. 9 illustrates a yellow ramp from dark yellow to bright yellow. A yellow made with Y, or R+G+Y should be the same color in the spectrum as a yellow made with R+G, only with the potential for greater brightness. In practice, darker colors are made with the primary colors only (in the example of FIG. 9, dark yellow is made with only Rpri and Gpri). For brighter yellows, a component of the Y overlay color is added, which increases with the desired brightness. The optimization process independently controls the illuminators in the overlay colors (either by time-based modulation or by current based modulation) to match the same color as produced by the primary colors. Thus, a nearly constant color point is maintained across each Y, M, C and W ramp, which results in more accurate colors across the spectrum.

Tables 7 through 10 illustrate the same calculations as above, but performed for BC2 bit-planes where the calculations do not have the requirement of a constant ratio shown in Table 5. To generate the data in Tables 7-10, the RGB duty cycle data is the same as shown in Table 1, and the error weights and tolerances are identical to those described for the BC1 bit-plane example above.

TABLE 7

Output Duty Cycles, Seq Color Perspective

| # | TotDC | RGBpri | Rpri | Gpri | Bpri | Yov | Cov | Mov | Wov |
|---|---|---|---|---|---|---|---|---|---|
| 0 | 1.000 | 0.8500 | 0.21584 | 0.42348 | 0.21068 | 0.07564 | 0.07436 | 0.00000 | 0.00000 |
| 1 | 1.000 | 0.8500 | 0.22167 | 0.43419 | 0.19414 | 0.08148 | 0.06852 | 0.00000 | 0.00000 |
| 2 | 1.000 | 0.8500 | 0.22667 | 0.44333 | 0.18000 | 0.08647 | 0.06353 | 0.00000 | 0.00000 |
| 3 | 1.000 | 0.8500 | 0.22773 | 0.40044 | 0.22183 | 0.07171 | 0.07829 | 0.00000 | 0.00000 |
| 4 | 1.000 | 0.8500 | 0.23096 | 0.41329 | 0.20574 | 0.07738 | 0.07262 | 0.00000 | 0.00000 |
| 5 | 1.000 | 0.8500 | 0.23845 | 0.37971 | 0.23184 | 0.06817 | 0.08182 | 0.00000 | 0.00000 |
| 6 | 1.000 | 0.8500 | 0.23983 | 0.42020 | 0.18997 | 0.08295 | 0.06705 | 0.00000 | 0.00000 |
| 7 | 1.000 | 0.8500 | 0.24230 | 0.43212 | 0.17558 | 0.08803 | 0.06197 | 0.00000 | 0.00000 |
| 8 | 1.000 | 0.8500 | 0.24341 | 0.39026 | 0.21633 | 0.07365 | 0.07635 | 0.00000 | 0.00000 |
| 9 | 1.000 | 0.8500 | 0.24583 | 0.35785 | 0.24632 | 0.06306 | 0.08694 | 0.00000 | 0.00000 |
| 10 | 1.000 | 0.8500 | 0.24683 | 0.44187 | 0.16130 | 0.09000 | 0.06000 | 0.00000 | 0.00000 |
| 11 | 1.000 | 0.8500 | 0.24833 | 0.40160 | 0.20007 | 0.07939 | 0.07061 | 0.00000 | 0.00000 |
| 12 | 1.000 | 0.8500 | 0.25459 | 0.36961 | 0.22580 | 0.07030 | 0.07969 | 0.00000 | 0.00000 |
| 13 | 1.000 | 0.8500 | 0.25603 | 0.40895 | 0.18502 | 0.08470 | 0.06530 | 0.00000 | 0.00000 |
| 14 | 1.000 | 0.8500 | 0.26109 | 0.41639 | 0.17252 | 0.08911 | 0.06089 | 0.00000 | 0.00000 |
| 15 | 1.000 | 0.8500 | 0.26134 | 0.37862 | 0.21004 | 0.07587 | 0.07413 | 0.00000 | 0.00000 |
| 16 | 1.000 | 0.8500 | 0.29138 | 0.31956 | 0.23906 | 0.06563 | 0.08437 | 0.00000 | 0.00000 |
| 17 | 1.000 | 0.8500 | 0.26844 | 0.38806 | 0.19350 | 0.08171 | 0.06829 | 0.00000 | 0.00000 |
| 18 | 1.000 | 0.8500 | 0.27972 | 0.33004 | 0.24025 | 0.09000 | 0.06000 | 0.00000 | 0.00000 |
| 19 | 1.000 | 0.8500 | 0.27452 | 0.39612 | 0.17937 | 0.08669 | 0.06331 | 0.00000 | 0.00000 |
| 20 | 1.000 | 0.8500 | 0.28087 | 0.40448 | 0.16464 | 0.09000 | 0.06000 | 0.00000 | 0.00000 |
| 21 | 1.000 | 0.8500 | 0.30316 | 0.34409 | 0.20275 | 0.07844 | 0.07156 | 0.00000 | 0.00000 |
| 22 | 1.000 | 0.8500 | 0.28657 | 0.33276 | 0.23067 | 0.06859 | 0.08141 | 0.00000 | 0.00000 |
| 23 | 1.000 | 0.8500 | 0.28582 | 0.41097 | 0.15321 | 0.09000 | 0.06000 | 0.00000 | 0.00000 |
| 24 | 1.000 | 0.8500 | 0.28741 | 0.37530 | 0.18729 | 0.08390 | 0.06610 | 0.00000 | 0.00000 |

TABLE 8

Output Duty Cycles, Illuminator Perspective

| # | RGBtot | Rpri | Gpri | Bpri | RinY | GinY | GinC | BinC |
|---|---|---|---|---|---|---|---|---|
| 0 | 1.150 | 0.2158 | 0.4235 | 0.2107 | 0.0756 | 0.0756 | 0.0744 | 0.0744 |
| 1 | 1.150 | 0.2217 | 0.4342 | 0.1941 | 0.0815 | 0.0815 | 0.0685 | 0.0685 |
| 2 | 1.150 | 0.2267 | 0.4433 | 0.1800 | 0.0865 | 0.0865 | 0.0635 | 0.0635 |
| 3 | 1.150 | 0.2277 | 0.4004 | 0.2218 | 0.0717 | 0.0717 | 0.0783 | 0.0783 |
| 4 | 1.150 | 0.2310 | 0.4133 | 0.2057 | 0.0774 | 0.0774 | 0.0726 | 0.0726 |
| 5 | 1.150 | 0.2385 | 0.3797 | 0.2318 | 0.0682 | 0.0682 | 0.0818 | 0.0818 |
| 6 | 1.150 | 0.2398 | 0.4202 | 0.1900 | 0.0830 | 0.0830 | 0.0670 | 0.0670 |
| 7 | 1.150 | 0.2423 | 0.4321 | 0.1756 | 0.0880 | 0.0880 | 0.0620 | 0.0620 |
| 8 | 1.150 | 0.2434 | 0.3903 | 0.2163 | 0.0736 | 0.0736 | 0.0764 | 0.0764 |
| 9 | 1.150 | 0.2458 | 0.3578 | 0.2463 | 0.0631 | 0.0631 | 0.0869 | 0.0869 |
| 10 | 1.150 | 0.2468 | 0.4419 | 0.1613 | 0.0900 | 0.0900 | 0.0600 | 0.0600 |
| 11 | 1.150 | 0.2483 | 0.4016 | 0.2001 | 0.0794 | 0.0794 | 0.0706 | 0.0706 |
| 12 | 1.150 | 0.2546 | 0.3696 | 0.2258 | 0.0703 | 0.0703 | 0.0797 | 0.0797 |
| 13 | 1.150 | 0.2560 | 0.4090 | 0.1850 | 0.0847 | 0.0847 | 0.0653 | 0.0653 |
| 14 | 1.150 | 0.2611 | 0.4164 | 0.1725 | 0.0891 | 0.0891 | 0.0609 | 0.0609 |
| 15 | 1.150 | 0.2613 | 0.3786 | 0.2100 | 0.0759 | 0.0759 | 0.0741 | 0.0741 |
| 16 | 1.150 | 0.2914 | 0.3196 | 0.2391 | 0.0656 | 0.0656 | 0.0844 | 0.0844 |
| 17 | 1.150 | 0.2684 | 0.3881 | 0.1935 | 0.0817 | 0.0817 | 0.0683 | 0.0683 |
| 18 | 1.150 | 0.2797 | 0.3300 | 0.2402 | 0.0900 | 0.0900 | 0.0600 | 0.0600 |
| 19 | 1.150 | 0.2745 | 0.3961 | 0.1794 | 0.0867 | 0.0867 | 0.0633 | 0.0633 |
| 20 | 1.150 | 0.2809 | 0.4045 | 0.1646 | 0.0900 | 0.0900 | 0.0600 | 0.0600 |
| 21 | 1.150 | 0.3032 | 0.3441 | 0.2028 | 0.0784 | 0.0784 | 0.0716 | 0.0716 |
| 22 | 1.150 | 0.2866 | 0.3328 | 0.2307 | 0.0686 | 0.0686 | 0.0814 | 0.0814 |
| 23 | 1.150 | 0.2858 | 0.4110 | 0.1532 | 0.0900 | 0.0900 | 0.0600 | 0.0600 |
| 24 | 1.150 | 0.2874 | 0.3753 | 0.1873 | 0.0839 | 0.0839 | 0.0661 | 0.0661 |

TABLE 9

| Overlap Color Ratios | | | | |
|---|---|---|---|---|
| # | RinY | GinY | GinC | BinC |
| 0 | 1.0000 | 1.0000 | 1.0000 | 1.0000 |
| 1 | 1.0000 | 1.0000 | 1.0000 | 1.0000 |
| 2 | 1.0000 | 1.0000 | 1.0000 | 1.0000 |
| 3 | 1.0000 | 1.0000 | 1.0000 | 1.0000 |
| 4 | 1.0000 | 1.0000 | 1.0000 | 1.0000 |
| 5 | 1.0000 | 1.0000 | 1.0000 | 1.0000 |
| 6 | 1.0000 | 1.0000 | 1.0000 | 1.0000 |
| 7 | 1.0000 | 1.0000 | 1.0000 | 1.0000 |
| 8 | 1.0000 | 1.0000 | 1.0000 | 1.0000 |
| 9 | 1.0000 | 1.0000 | 1.0000 | 1.0000 |
| 10 | 1.0000 | 1.0000 | 1.0000 | 1.0000 |
| 11 | 1.0000 | 1.0000 | 1.0000 | 1.0000 |
| 12 | 1.0000 | 1.0000 | 1.0000 | 1.0000 |
| 13 | 1.0000 | 1.0000 | 1.0000 | 1.0000 |
| 14 | 1.0000 | 1.0000 | 1.0000 | 1.0000 |
| 15 | 1.0000 | 1.0000 | 1.0000 | 1.0000 |
| 16 | 1.0000 | 1.0000 | 1.0000 | 1.0000 |
| 17 | 1.0000 | 1.0000 | 1.0000 | 1.0000 |
| 18 | 1.0000 | 1.0000 | 1.0000 | 1.0000 |
| 19 | 1.0000 | 1.0000 | 1.0000 | 1.0000 |
| 20 | 1.0000 | 1.0000 | 1.0000 | 1.0000 |
| 21 | 1.0000 | 1.0000 | 1.0000 | 1.0000 |
| 22 | 1.0000 | 1.0000 | 1.0000 | 1.0000 |
| 23 | 1.0000 | 1.0000 | 1.0000 | 1.0000 |
| 24 | 1.0000 | 1.0000 | 1.0000 | 1.0000 |

TABLE 10

| Weighted Errors | | | |
|---|---|---|---|
| | Error | Weight | Weighted Error |
| Overlap Sum | 0.000000 | 1.000000 | 0.000000 |
| Sum of RGB Primaries | 0.000000 | 1.000000 | 0.000000 |
| R primary, G primary, B primary | 0.155094 | 1.000000 | 0.155094 |
| Cumul R, Cumul G, Cumul B | 0.451505 | 1.000000 | 0.451505 |
| Y Dark Time | 0.000000 | 10.000000 | 0.000000 |
| C Dark Time | 0.000000 | 10.000000 | 0.000000 |
| M Dark Time | 0.000000 | 10.000000 | 0.000000 |
| W Dark Time | 0.000000 | 10.000000 | 0.000000 |
| Total Obj Function Error | | | 0.606598 |

As can be seen, eliminating the hard constraint for the constant ratio improves errors in other areas—in particular, the amount of dark time. This leads to increased brightness, since both illuminators are enabled for the entirety of the overlap color sub-sequence (or if current-based modulation is used, both illuminators are driven with full current).

The invention provides significant advantages over the prior art. First, the invention generates duty cycles that allow a single set of mapping tables to be used to map data from a first set of colors to a second set of colors including one or more selected overlap colors over multiple duty cycle sequences. Second, the duty cycles yield a constant color point across ramp of each overlap color. The duty cycles may be generated to have a constant ratio between each primary color and the same illuminator with an overlap color. The data from the generated duty cycles may be used to modulate the illuminators during overlap color sub-sequences as a matter of time or current.

The preceding embodiments presume that the illuminators have nearly instantaneous rise and fall times and level illumination once enabled. For high quality LEDs, for example, those assumptions are correct. However, use of one or more lower cost illumination systems (including the illuminator power supply and driver) in a display system may result in rise and fall times, or illumination decay over time, that affects the calculations.

Figure 10:
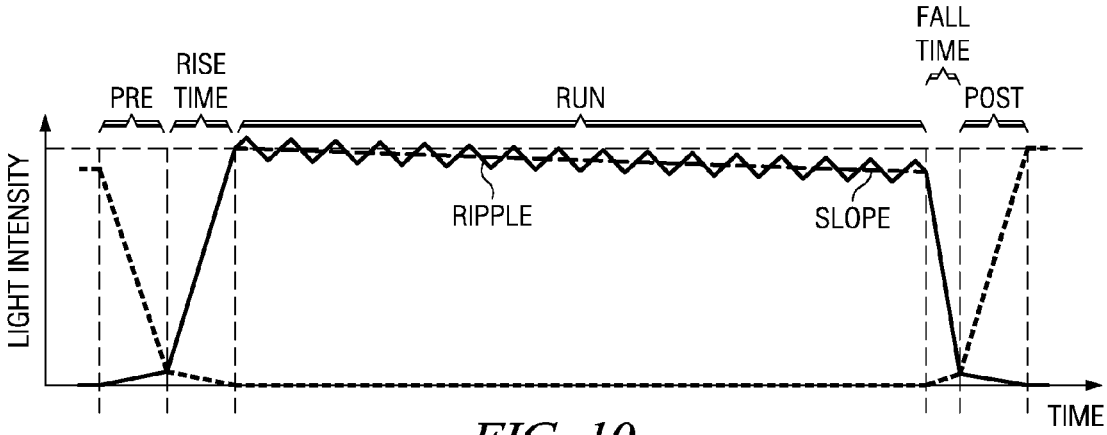
FIG. 10 illustrates a graph showing the light intensity of a illumination source which varies significantly from an idealized light source.

FIG. 10 illustrates the output of an LED. From a disabled (off) state, the light intensity increases slightly over a "Pre" time period, then rises to full illumination over a "rise time" period. The intensity decays slightly over the "run" time period as the LED remains in an enabled state. When the LED is disabled, the light intensity drops to almost zero over a "fall time". During a "post" time period, the light intensity drops to zero. These basic characteristics can also be found in lasers as well.

The light intensity during the pre and post periods can be ignored, since it is so small. However, the rise time and fall time periods will be part of the sequence during which the light is modulated by the DMD, although it will be at a lesser intensity than that during the run time. Thus, the rise time of an illuminator should not be concurrent with the fall time of another, unless the rise and fall times are near ideal. Rise time periods of two or more illuminators can be concurrent, as can the fall time periods of two or more illuminators.

The optimization system can be used to determine the optimum solution relative to constraints and weighted error calculations for illuminators that do not have near ideal qualities.

For optimizations using one or more non-ideal illuminators, the order of sub-sequences in the subframe can be important. As shown in FIG. 10, the sequence RYGCB allows each illuminator to be enabled and disabled only once per subframe. This generally maximizes brightness by reducing the number falling and rising time periods.

Figure 11:
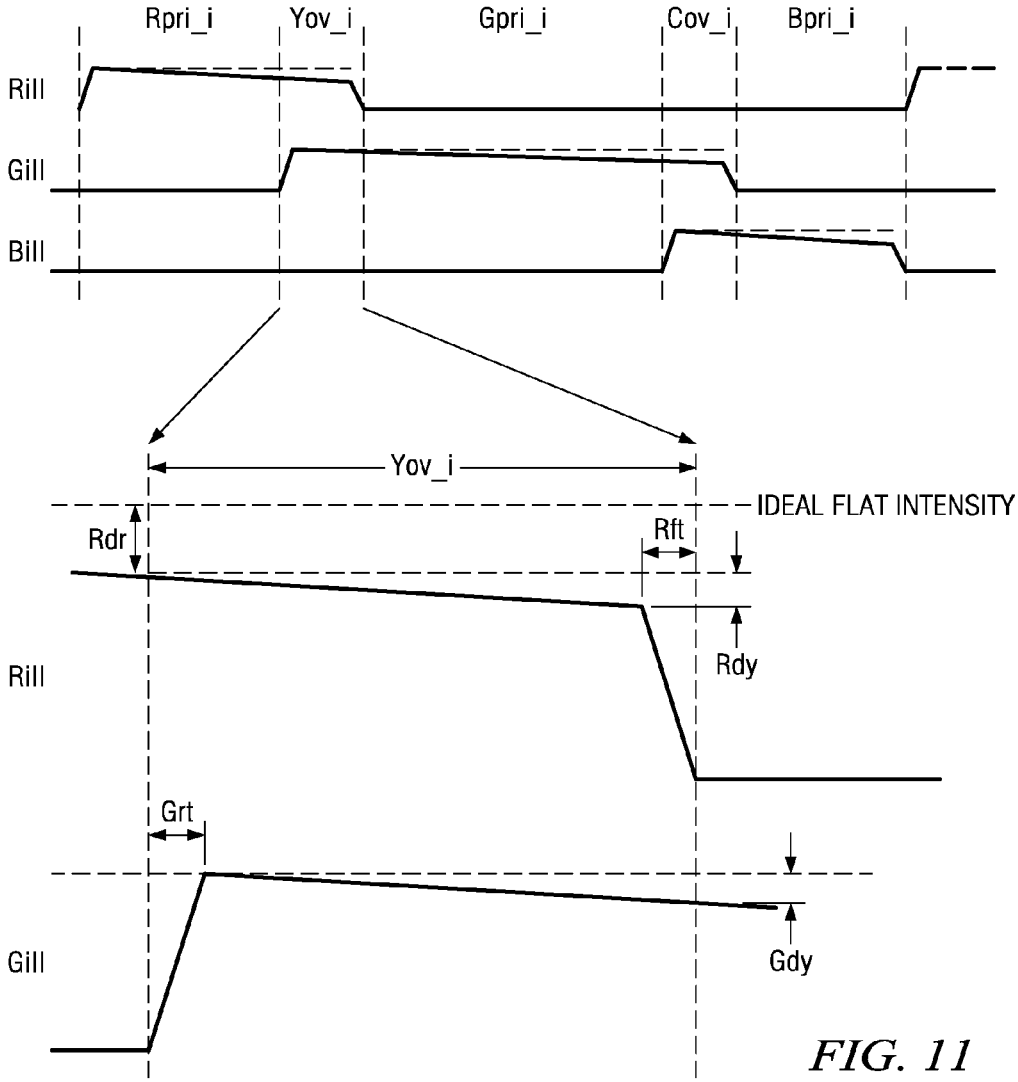
FIG. 11 illustrates a timing diagram of RGB system implementing RGBYC sequences using non-ideal illumination sources, with an exploded view of the Y sequence.

In FIG. 11, the ideal fractional allocations of the sub-frame are shown as Rpri_i, Yov_i, Gpri_i, Cov_i, and Bpri_i. The following adjustments provide non-idealized values (for the given example) for Rpri, Rtot, Gpri, Gtot, Bpri and Btot used in the error functions described above:

$$Rpri=Rpri_i-0.5*Rrt-0.5*Rdr*(Rpri_i-Rrt)$$

$$RinY=Yov_i(1-Rdr)-0.5*Rdy*(Yov_i-Rft)-0.5*Rft*(1-Rdr+Rdy)$$

$$Gpri=Gpri_i(1-Gdy-0.5*Gdg)$$

$$GinY=Yov_i-0.5*Grt-0.5*Gdy*(Yov_i-Grt)$$

$$GinC=Cov_i(1-Gdg-Gdy)-0.5*Gdc*(Cov_i-Gft)-0.5*Gft*(1-Gdg-Gdy+Gdc)$$

$$Bpri=Bpri_i(1-Bdc)-0.5*Bdb*(Bpri_i-Bft)-0.5*Bft*(1-Bdc+Bdb)$$

$$BinC=Cov_i-0.5*Brt-0.5*Bdc*(Cov_i-Brt)$$

where:

Rpri_i=idealized R primary value (ignoring rise/fall times and decay)

Gpri_i=idealized G primary value (ignoring rise/fall times and decay)

Bpri_i=idealized B primary value (ignoring rise/fall times and decay)

Yov_i=idealized Y overlap value (ignoring rise/fall times and decay)

Cov_i=idealized C overlap value (ignoring rise/fall times and decay)

Rrt=rise time of R illuminator as fractional portion of subframe

Rft=fall time of R illuminator as fractional portion of sub-frame

Grt=rise time of R illuminator as fractional portion of sub-frame

Gft=fall time of R illuminator as fractional portion of sub-frame

Brt=rise time of R illuminator as fractional portion of sub-frame

Bft=fall time of R illuminator as fractional portion of sub-frame

Rs=slope of R illumination decay over subframe as fractional portion of full R illumination Gs=slope of G illumination decay over subframe as fractional portion of full G illumination Bs=slope of B illumination decay over subframe as fractional portion of full B illumination Rdr=decay of R illuminator during Rpri_i, as fractional portion of full R illumination (Rdr=Rs*(Rpri_i−Rrt))

Gdg=decay of G illuminator during Gpri_i, as fractional portion of full G illumination (Gdg=Gs*Gpri_i)

Bdb=decay of B illuminator during Bpri_i, as fractional portion of full B illumination (Bdb=Bs*(Bpri_i−Bft))

Rdy=decay of R illuminator during Yov_i, as fractional portion of full R illumination (Rdy=Rs*(Yov_i−Rft))

Gdy=decay of G illuminator during Yov_i, as fractional portion of full G illumination (Yd=Gs*(Yov_i−Grt))

Bdc=decay of B illuminator during Cov_i, as fractional portion of full B illumination (Cdb=Bs*Cov_i−Brt)

Gdc=decay of G illuminator during Cov_i, as fractional portion of full G illumination (Cdb=Gs*(Cov_i−Gft))

To calculate the non-idealized Rpri, portions attributable to rise time and illumination decay are subtracted from the idealized value, Rpri_i. The reduction in illumination attributable to the rise time can be calculated at a triangle of height=1 and width=Rrt (since both Rrt and Rpri_i are normalized to the subframe). The reduction in illumination attributable to decay of the illumination over time can be calculated at a triangle of height Rdr (equal to Rs*Rpri_i) and width Rpri_i−Rrt.

To calculate RinY, a rectangle of height Rdr and width Yov_i and a triangle of height Rdy and width Yov_i are subtracted from the idealized Yov_i to account for the decay of the R illuminator during the R sequence and for the further decay of the R illuminator during the Y sequence. Additionally, a triangle of width Rft and height 1−Rdr−Rdy is subtracted to account for the fall time of the R illuminator at the end of the Y sequence.

GinY is calculated similarly to Rpri. Gpri is calculated similarly to RinY, except without account for a fall time at the end of the sequence (since the G illuminator remains on for the C sequence). GinC is calculated similarly to RinY, except the height of the rectangle is equal to the sum of Gdy+Gdg, since the Green illuminator has decayed over both the Y and G sequences by the time C is started. BinC is calculated similarly to Rpri and Bpri is calculated similarly to RinY.

The values of Rpri, Gpri, Bpri, RinY, GinY, GinC and BinC can be used in the error function calculations discussed above to determine a set of allocations of the subframe with the lowest weighted error and highest illumination.

As discussed above, the DSP chooses an RGB sequence which is closest to a calculated RGB sequence to maintain a specific white point, and may then tweak the output by lowering the current driving one or more of the illuminators to reach a nearly exact white point. This tweaking adjustment of the current is independent of the current adjustment shown in Tables 3 and 4.

The tweaking adjustment could be eliminated, resulting in greater brightness, by performing the calculation in real-time by the DSP, or other processor, on the calculated RGB sequence, rather than on the selected RGB sequence. The number of possible scenarios including overlap colors could be greatly reduced by setting the tolerances to the individual Rtot, Gtot and Btot values to zero. The DSP (or other processor) could then calculate and evaluate the error functions for the reduced set of scenarios.

While the invention has been discussed in connection with creating Y, C, M, and W overlap colors from R, G, B and B illuminators, it should be noted that one or more Y, M, W or C illuminators could be used. For example, a RGBC would use R, G, B and C illuminators and could still generate Y, M and W overlap colors using the invention.

Those skilled in the art will appreciate that modifications may be made to the described example embodiments, and that many other embodiments are possible, within the scope of the claimed invention.

The invention claimed is:

1. A method of controlling red, green and blue solid-state illuminator systems to produce respective red, green and blue primary colors and at least two of yellow, cyan, magenta and white overlap colors using two or more of the red, green and blue solid-state illuminator systems to illuminate a spatial light modulator in a display system, comprising the steps of:

providing a first set of duty cycles of the primary colors over a frame, wherein the display system can select one of the first set duty cycles to produce a desired color point;

determining a second set of duty cycles of the primary and the at least two overlap colors over a frame corresponding to the first set of duty cycles, wherein the second set duty cycles are generated responsive to a specified desired allocation of the frame to the at least two overlap colors, such that each of the at least two overlap colors can be displayed from a dark shade to a bright shade while maintaining a constant color point.

2. The method of claim 1 wherein said determining step comprises the steps of:

generating a plurality of alternative scenarios for said second set of duty cycles; and evaluating each alternative scenario by calculating error functions relating the portions of the frame that each illuminator system is enabled in that scenario relative to desired portions determined by the first set of duty cycles to determine a selected scenario.

3. The method of claim 2 wherein the step of calculating error functions includes the step of calculating, for each duty cycle in that scenario, the difference between the illumination from all illuminator systems over a frame and the expected illumination based on the specified desired overlap allocation.

4. The method of claim 3 wherein the error function accumulates the difference for each duty cycle in that scenario.

5. The method of claim 2 wherein the step of calculating error functions includes the step of calculating, for each duty cycle in that scenario, the difference between the sum of the primary color portions used in a frame according to the duty cycle and the sum of the expected primary color portions within the frame.

6. The method of claim 5 wherein the error function accumulates the difference for each duty cycle in that scenario.

7. The method of claim 2 wherein the step of calculating error functions includes the step of calculating, for each duty cycle of that scenario, a difference between an expected portion of illumination for each primary color based on the apportionment of the primary colors in a corresponding duty cycle of the first set and the portion of the frame in which the illuminator system for the primary color would be enabled to produce either primary or overlap colors, according to that duty cycle of that scenario.

8. The method of claim 7 wherein the error function accumulates the difference for each duty cycle for all duty cycles in that scenario.

9. The method of claim 2 wherein the step of calculating error functions includes the step of calculating, for each duty cycle in that scenario, the difference between an expected portion of illumination for each primary color based on the apportionment of the primary colors in a corresponding duty cycle of the first set and the portion of the frame in which the illuminator system for the primary color would be enabled for primary colors only, according to that duty cycle of that scenario.

10. The method of claim 9 wherein the error function accumulates the difference for each duty cycle for all duty cycles in that scenario.

11. The method of claim 1 wherein said determining step maintains, for each illuminator system, a constant ratio between the portion of the frame in which that illuminator system is used to produce a primary color and the portion of the frame in which that same illuminator system is used to produce an overlap color.

12. The method of claim 1 wherein one or more of the illuminator systems producing an overlap color may be enabled for less than all of the portion of the frame allocated to the overlap color.

13. The method of claim 2 wherein the step of calculating error functions includes the step of calculating, for each duty cycle of that scenario, part of a portion of the frame allocated to an overlap color in which one of the illuminator systems producing the overlap color is not enabled.

14. The method of claim 2 wherein the step of calculating error functions includes the step of calculating, for each duty cycle of that scenario, part of a portion of the frame allocated to an overlap color in which one of the illuminator systems producing the overlap color is enabled at less than a full intensity.

15. The method of claim 2 wherein each error function is weighted.

16. The method of claim 1 wherein a tolerance is provided to allow the allocation of the overlap colors in a duty cycle of the second set to vary from the specified desired allocation within a certain range.

17. The method of claim 2 wherein the error functions account for a non-ideal ramping by each illumination system ramping from a low intensity to a full intensity state.

18. The method of claim 2 wherein the error functions account for a non-ideal ramping by each illumination system ramping from a full intensity to a low intensity state.

* * * * *